United States Patent [19]

Hendrix et al.

[11] 4,130,248

[45] Dec. 19, 1978

[54] METHOD AND APPARATUS FOR PACKAGING MULTISTRAND ROVING

[75] Inventors: Ronald W. Hendrix, Columbus; Jerome P. Klink, Granville; John W. Dunn, Sylvania, all of Ohio

[73] Assignee: Owens-Corning Fiberglas Corporation, Toledo, Ohio

[21] Appl. No.: 799,059

[22] Filed: May 20, 1977

[51] Int. Cl.[2] ..... B65H 54/02

[52] U.S. Cl. ..... 242/18 G; 65/11 W; 242/42; 242/43 R

[58] Field of Search ..... 242/18 G, 18 R, 42, 242/43 R; 65/11 W

[56] References Cited

U.S. PATENT DOCUMENTS

| | | | |
|---|---|---|---|
| 533,934 | 2/1895 | Wardwell | 242/42 X |
| 2,345,544 | 3/1944 | Worthington | 242/42 |
| 3,254,978 | 6/1966 | Hayes | 242/42 X |
| 3,371,877 | 3/1968 | Klink et al. | 242/18 G |
| 3,653,860 | 4/1972 | Smith et al. | 242/42 X |
| 3,717,311 | 2/1973 | Smith | 242/18 G X |
| 3,801,032 | 4/1974 | Sears et al. | 242/18 G X |

*Primary Examiner*—Stanley N. Gilreath

*Attorney, Agent, or Firm*—Ronald C. Hudgens; Kenneth H. Wetmore; Harry O. Ernsberger

[57] ABSTRACT

The disclosure embraces a method of and apparatus for producing a roving package of strands of attenuated glass fibers or filaments, the method and apparatus involving segregating the fibers or filaments into bundles or strands in spaced relation and the bundles or strands wound into a package with the bundles or strands advanced toward the package in a plane substantially normal to the longitudinal axis of the package whereby the individual bundles or strands engage the package at peripherally spaced surface regions and are collected in side-by-side or waywound relation.

14 Claims, 10 Drawing Figures

METHOD AND APPARATUS FOR PACKAGING MULTISTRAND ROVING

It has been a practice to wind a roving comprising a plurality of strands of fibers or filaments, such as glass fibers or filaments, into a package whereby strands of fibers or filaments are converged into a roving by a gathering device and winding the roving as a linear unitary body into a package wherein all of the strands engage the package surface simultaneously.

It is conventional practice to subdivide a group of fibers or filaments attenuated from glass streams into several strands guided in spaced relation lengthwise of a package and the spaced strands converged into a roving adjacent the package. This prior method of forming a package of roving is of the character disclosed in the U.S. Patent to Klink et al. U.S. Pat. No. 3,371,877.

Multistrand roving is further processed by severing the roving into short lengths for use as reinforcement in articles or products formed of molded resinous or plastic material. In forming a multistrand roving it is found desirable to subdivide the fibers or filaments into strands which are converged into a roving at the package, the fibers or filaments tending to remain in strand formations in the roving.

When the roving is severed into short lengths and embodied as reinforcement in molded resinous products, the fibers or filaments of each short length strand tend to remain in a strand group, thus tending to minimize the surfacing or prominence of individual fibers or filaments at the surface of a molded end product. It is usual practice to apply a coating or sizing onto the fibers or filaments which is compatible with the resin used for the molded product.

The present invention resides in a method of winding a multistrand roving into a package involving guiding the individual strands as they are advanced toward the package in a manner whereby the individual strands of the roving are maintained in spaced relation so that the strands successively engage peripherally spaced surface regions on the package and are collected on the package in side-by-side or waywound relation.

An object of the invention embraces a method of forming a wound package of roving involving spacing and guiding individual strands of the roving toward the package in a manner such that each of the strands traverses different angular path so that each strand engages the periphery of the package at a different peripheral region whereby the individual strands of the roving in the package are in a band-like side-by-side relation, this method facilitating the formation of a square end package without the use of special roving compacting means at the ends of the package.

Another object of the invention resides in a method of forming a package of roving comprising a plurality of strands of glass fibers or filaments wherein the collection on the package of individual strands at spaced peripheral regions of the package provides a multistrand roving whereby in the use of severed lengths of the roving in molded resinous products, there is a minimum tendency for bunches of clumps of the severed fibers or filaments to lodge at the surface of a molded resinous product.

Another object of the invention resides in the provision of an apparatus or arrangement for controlling or guiding the strands of a multistrand roving onto a package wherein the individual strands are engaged at spaced peripheral regions of the surface of the package and wherein the strands are collected on the package in side-by-side relation.

Another object of the invention resides in an apparatus for forming roving into a wound package involving a strand control or guide means for spacing the individual strands in a plane normal to the axis of the package and wherein the control or guide means is adjustable to facilitate separation of the strands at start-up of winding operations.

Further objects and advantages are within the scope of this invention such as relate to the arrangement, operation and function of the related elements of the structure, to various details of construction and to combinations of parts, elements per se, and to economies of manufacture and numerous other feature as will be apparent from a consideration of the specification and drawing of a form of the invention, which may be preferred, in which.

While the method and apparatus of the invention are particularly usable with means attenuating streams of heat-softened mineral material, such as glass, into fibers or filaments and winding a roving of strands of the fibers or filaments into a package, it is to be understood that the method and apparatus may be utilized for packaging roving of strands of fibers or filaments derived from spools or supplies or preformed strands.

Figures 1, 2:
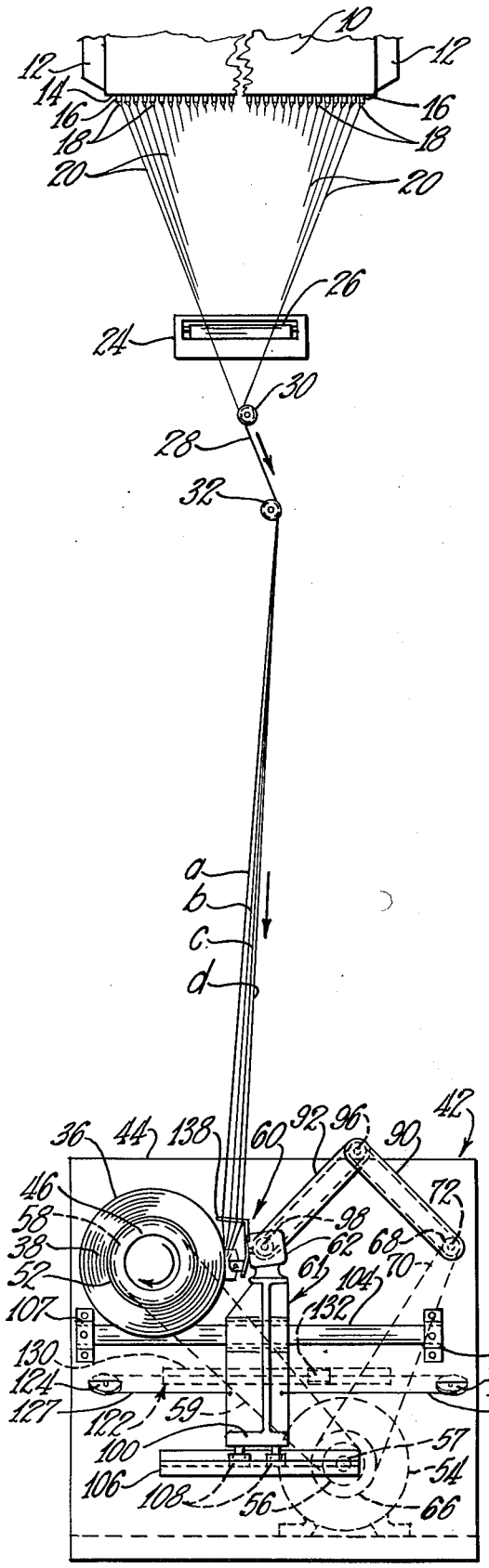
FIG. 1 is a semidiagrammatic front elevational view of an apparatus for carrying out the method of forming and packaging multistrand roving.
FIG. 2 is a side elevational view of the apparatus illustrated in FIG. 1.

Referring initially to FIGS. 1 and 2 of the drawings, there is illustrated a stream feeder or bushing 10 containing a supply of heat-softened glass or other filament-forming mineral material. The feeder 10 may be connected with a forehearth (not shown) supplied with softened glass from a furnace. The feeder 10 is provided at its ends with terminal lugs 12 adapted to be connected with a source of electric energy for heating the glass in the feeder to maintain the glass at a proper temperature and viscosity for forming fibers or filaments.

A floor or tip section 14 of the feeder 10 is provided with a large number of depending projections or tips 16, the projections having orifices therein for flowing streams 18 of the glass or other filament-forming material from the feeder. The streams are attenuated into individual continuous fibers or filaments 20.

It may be desirable to apply water or a coating, size or lubricant onto the filaments of glass depending upon the particular end use for the roving formed of the filaments. For this purpose an applicator housing 24 supports an applicator 26, shown in FIGS. 1 and 2, in which the applicator may be and endless belt partially immersed in the liquid material contained in the housing 24 for transferring the material to the filaments through the wiping action of the filaments engaging the liquid material on the applicator belt 26.

The fibers or filaments 20 are converged into a linear group or bundle 28 by engaging the filaments with a gathering shoe or grooved roll 30. The group 28 of filaments is then passed over an idler roll 32. In forming the roving, the group 28 of filaments is subdivided or separated into individual strands, there being four strands designated a, b, c and d in FIGS. 1. 3 and 5. The winding of the roving 36 into a package 38 attenuates the glass streams 18 into filaments 20. Thus, the strands a, b, c and d are collected as a roving 36 on the package.

The arrangement for subdividing or separating the group or bundle of fibers or filaments 28 into individual strands a, b, c and d and the method and arrangement for traversing the individual strands and collecting the strands as a roving on the package will be hereinafter described. While the group or bundle of filaments 28 is illustrated as subdivided into four separate untwisted strands a, b, c and d, it is to be understood that a lesser or greater number of individual strands may comprise the roving 36.

The winding machine or apparatus 42 illustrated is of the general character disclosed in U.S. Pat. No. to Smith 3,717,311. The winding apparatus 42 includes a housing or frame construction 44. Journally mounted by the housing 44 is a package winding mandrel or collet 46 connected with a drive shaft 48 through speed reducing mechanism (not shown) contained within a member 50 supported within the housing 44. The winding mandrel 46 is adapted to telescopingly receive a tubular collector, sleeve or forming tube 52 upon which a roving package 38 is formed.

A variable speed, electrically energizable motor 54 mounted within the housing 44 is adapted to rotate the drive shaft 48 and the collet 46. A sheave 56 mounted on the motor shaft 57 drives a sheave 58 on the shaft 48 by a belt 59. A strand guide and traversing arrangement 60 is provided for subdividing the group of filaments 28 into the individual or separate strands or bundles a, b, c and d and traversing the advancing bundles of filaments or strands axially of the package 38 to effect deposition of the roving formed by the strands lengthwise on the package.

The traverse arrangement of the winding machine embodies means for maintaining a strand guide member in contact with the surface of a package during winding, the member functioning as a sensing means responsive to the increasing size of the package for effecting movement of the traverse mechanism in successive increments away from the package while maintaining the strand guide member at the circumferential surface of the package. The components of the traversing mechanism are mounted by a relatively movable support 61.

Figure 3:
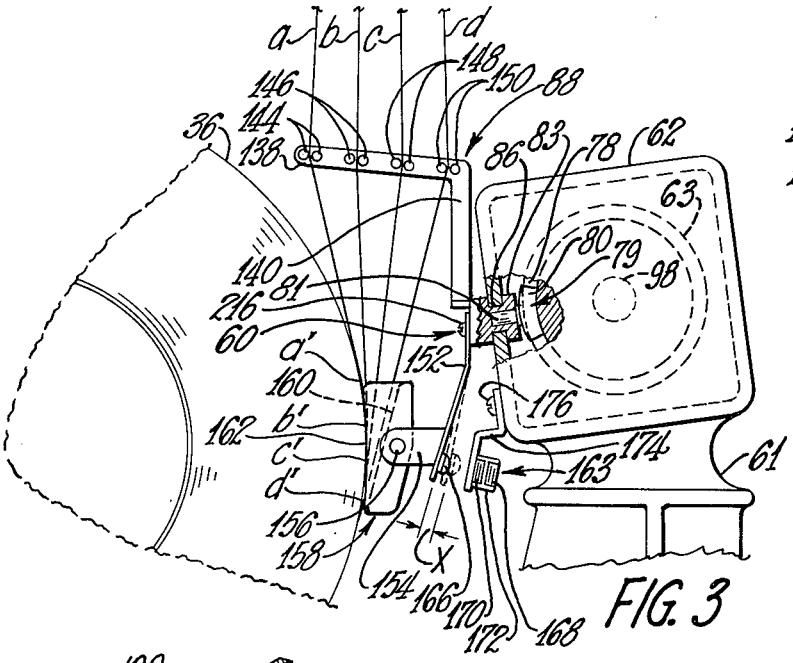
FIG. 3 is an enlarged elevational view of the traversing arrangement illustrating guide means for spacing the individual strands of a roving.

As shown in FIG. 3, the support 61 mounts a cam housing 62 in which is journally supported a cylindrical traversing cam 63 which is driven by the motor 54. The shaft 57 of the motor 54 is equipped with a second sheave 66 which drives a sheave 68 through a connecting belt 70, the sheave 68 being mounted upon and driving a shaft 72. The speed of the motor shaft 57 determines the rotational speed of the collet or mandrel 46 and the speed of the traversing mechanism for the strands of the roving.

The cylindrical traversing cam 63 has a multiple return groove 78 accommodating a cam follower 79. The cam follower 79 is fashioned with an arcuate portion 80 received in the cam groove 78. The cam follower 79 has a tenon portion 81 which fits into a bore 82 formed in a traverse member or slide block 83.

The traverse member or slide block 83 has grooves 84 whereby the same is mounted in a lengthwise arranged slot 86 in the housing 62, the member 83 being slidably reciprocable in the slot. During operation of the traverse mechanism, the journal support for the cam follower 79 in the traverse member or slide block 83 allows swivel or pivotal movement of the follower at the reversal regions of the cam groove 78.

Mounted by the reciprocable traverse member 83 is a strand spacing and guide construction 88 which will be hereinafter described. Rotation of the cylindrical traversing cam 63 moves the cam follower 79 and member 83 in a rectilinear path during their reciprocatory movements under the influence of rotation of the traversing cam 63. The driven shaft 72 rotates the cylindrical traversing cam 63 through a drive system contained within hollow connectors or members 90 and 92.

The shaft 72 is journally supported within a member 94 mounted by the winding machine housing 44. One end region of the connector 90 is pivoted for movement about the axis of the shaft 72, the opposite end of the connector 90 being pivotally connected with one end region of the connector 92 by a shaft 96. The other end region of the connector 92 is pivoted for movement about a shaft 98 which is journaled on the cam housing 62 and drives or rotates the cylindrical traverse cam 63.

Rotation of the shaft 72 is transmitted to the traverse cam driving shaft 98 by means of conventional sprockets and belts contained within the hollow connectors 90 and 92. The connection of the connectors about the axis of the shaft 96, the support of the connector 90 provided by the shaft 72 and the connection of the connector 92 with the cam housing 62 about the axis of the shaft 98 provide a toggle arrangement whereby the cam housing 62 and the support 61 are moved as a unit as the package 38 increases in size while maintaining a drive arrangement for the traverse cam 63.

The support 61 includes a base section 100 and an extending section or portion 102, parallel guide means including a stationary rod or shaft 104 and a stationary channel member 106 providing a mounting for the support 61 and the traverse cam housing 62. The rod 104 is supported by brackets 107 mounted by the housing 44. The rod 104 extends through a bore in the support 61, the latter being slidable along the rod 104. Guide means 108 on the base portion 100 of the support 61 are slidable in the channel member 106. Through this arrangement, the support 61 and the components mounted thereby are guided for horizontal slidable movement.

The support means 61, the traverse housing 62 and components of the traverse mechanism are moved relative to the package or roving being formed to accommodate the increase in the size of the package during winding operations. The control of the relative position of the support 61 is hereinafter described. In the embodiment illustrated, a fluid biasing means is utilized to provide for incremental movements of the support 61 as the package increases in size.

A fluid biasing means, such as an air motor 122, in association with rotatably mounted disc guides 124 and 125 and cords or cables 127 and 128 are shown in FIG. 1. The air motor 122 includes a cylinder 130 in which is reciprocably disposed a piston 132. One end of each of the cables 127 and 128 is connected to the piston 132 and the other end of each of the cables is secured to the support 61, the respective cables passing over the discs 124 and 125.

Compressed air is utilized to provide incremental movements of the support 61 and traverse mechanism away from the package as the package increases in size. A package sensing arrangement responsive to the increasing size of the package controls the admission of compressed air into the cylinder 130. The flow of compressed air to one side or the other of the piston 132 in the cylinder 130 and the venting of air from the cylinder are initiated by an arrangement of solenoid-operated valves of the character disclosed in the U.S. Pat. No. to Smith 3,717,311.

Braking means is provided for stopping rotation of the package at the completion of a winding operation. As shown in FIG. 2, the shaft 48 is equipped with a brake disc 134 in association with a solenoid-operated braking means 135. The braking means is energized to engage the brake disc 134 when the package is completed to stop rotation of the package.

The roving 36 produced according to the method and apparatus of the invention comprises a plurality of untwisted strands a, b, c and d of filaments which are deposited in side-by-side or waywound relation in the package 38, the method of collection or deposition of the strands of the roving on the package forming a square end package as shown in FIG. 2.

In forming the roving 36, the strands are separated and controlled or guided so as to be advanced toward the package in spaced relation in a plane substantially normal to the axis of the package to control the orientation or collection of the individual strands of the roving on the package. In the arrangement illustrated in FIGS. 1 through 4, the strand spacing means includes a member 138 having a downwardly extending portion 140 secured to or mounted by the traverse member 83 as shown particularly in FIG. 4.

Figure 4:
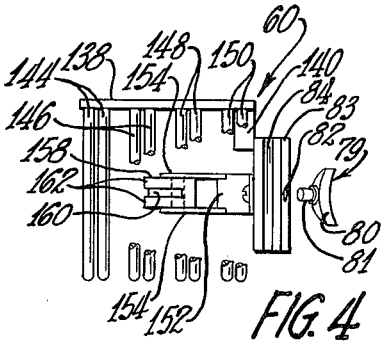
FIG. 4 is a top plan view of a portion of the traverse means and guide means for spacing the strands of the roving.

The member 138 is disposed in a plane normal to the axis of the collet 46 on which the package or roving is wound. Mounted upon the member 138 are means for spacing or separating the individual strands a, b, c and d of fibers or filaments substantially in a plane normal to the axis of the mandrel 46. As shown in FIGS. 3 and 4, the strand spacing means comprises pairs of rods 144, 146, 148 and 150, each pair of rods providing guide means for the individual strands a, b, c and d.

The rods of each pair are spaced sufficiently to freely accommodate the passage of an individual strand of fibers or filaments and maintain the strands in spaced relation. As shown in FIG. 3, the individual strands as they are advanced toward the package move in paths substantially in a plane normal to the axis of the collet or mandrel 46 and tangential to the surface of the package. By reason of the different angularities of advancement of the indivudual strands, the strands a, b, c and d engage the peripheral surface of the package at successively spaced peripheral regions of the package.

Secured to the traverse member or slide block 83 is a downwardly extending member or strip 152 which is of flexible metal forming a plate spring. The lower portion of the plate spring 152 is configurated with laterally extending projections or portions 154 as shown in FIGS. 3 and 4. Pivoted to the projections 154 by means of a pin 156 is a strand guide means, block or member 158 which also functions as a component of a sensing means for sensing the increasing size of the package.

The block 158 is fashioned with a groove or recess 160 of a depth shown in FIG. 3, the groove 160 accommodating the strands a, b, c and d. The surfaces 162, shown in FIG. 4, of the portions of the block at each side of the groove are normally in engagement with the peripheral or circumferential surface of the package being formed. In operation, the strand guide block 158 is reciprocated axially of the package with its package-engaging surfaces 162 lightly pressed by the spring 152 against the circumferential surface of the package.

The means sensing the size of the package and for repositioning the traverse means by increments are provided to maintain the proper relationship of the traverse means with respect to the package as the package increases in size. The sensing means includes a switch means 163 for controlling the operation of a conventional solenoid actuated valve system for the air motor 122, the valve system controlling the flow of compressed air for the air motor 122 to intermittently reposition the support 61, the traverse mechanism and the block 158 as the package increases in size.

The sensing and control arrangement includes a natural magnet 166 mounted of the flexible strip 152 and a second magnet 168 which are cooperable to actuate the contacts of a reed-type switch 170. The magnet 168 and the switch 170 are enclosed in a housing 172 mounted on a support 174, the latter being mounted on the traverse cam housing 62 by securing means 176.

The housing 172 is of nonconducting material and the member 174 is made of nonmagnetic material such as a resin-textile laminate commercially known as Micarta. The switch means 163 and the magnet 168 are fixed with respect to the traverse housing 62 while the magnet 166 is movable with the strip 152 and the traverse member 83. The plastic housing 172 enclosing the reed switch 170 is secured on the support member 174 facing away from the spring strip 152. The plastic housing 172 is preferably located at the mid region of the reciprocating stroke of the guide block 158.

The strand guide and sensor block 158 is urged radially of the package into engagement with the package surface by the light pressure of the plate spring or strip 152. When the package size increases to an extent that the magnet 166 and the magnet 168 are attracted toward each other, the magnetic force causes the magnet 166 to move toward the magnet 168 flexing the strip or member 152, the strip being moved radially away from the package an amount indicated by "X" in FIG. 3.

This relative radial movement of magnet 166, when it is in registration or coincident with the switch means 163, effects a closing of the switch member 170 which actuates the electrical control of the solenoid valve mechanism for the air motor 122 to vary the pressures at the respective sides of the piston 132 in the air cylinder 130 to shift the support 61 and the traversing mechanism 60 carried thereby away from the package a minute or very small distance as determined by the electrical control of the valve mechanisms of the compressed air system.

The extent of movement of the support 61 and traverse mechanism away from the package at each repositioning of the traverse mechanism is restricted so that the magnets 166 and 168 are out of registration resulting in the flexible plate spring 152 re-engaging the strand guide and sensor block 158 with the periphery of the package of roving being formed.

It is to be understood that the displacement distance indicated at "X" of the strand guide block 158 in closing the switch means 163 may be varied by changing the locations of the magnets or employing magnets having different magnetic strengths. The electrical system activated by the switch means 163 is of a character whereby successive closings of the switch member 170 progressively reduce the speed of the winding motor 54 and thereby progressively reduce the speed of the winding collet so as to maintain substantially constant the linear travel of the roving so that the attenuated filaments 20 comprising the roving are of substantially uniform size.

Figure 5:
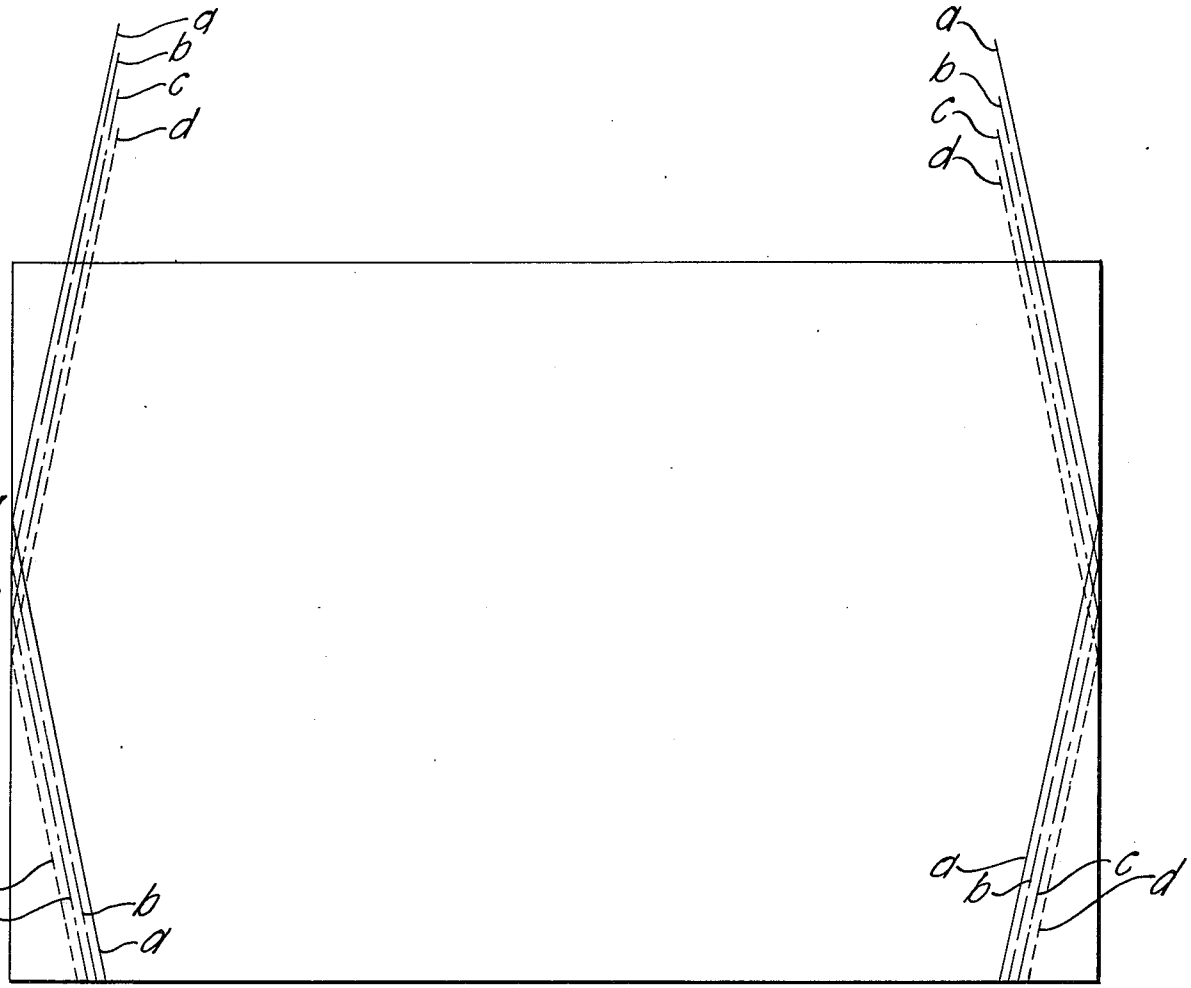
FIG. 5 is a schematic view illustrating the pattern or orientation of the strands of the roving on the package.

FIGS. 3 and 5 illustrate semischematically the paths of travel and pattern of orientation of the strands as they advance toward the package. Each of the strands a, b, c and d travels toward the periphery of the packate at a different angle as indicated in FIG. 3, the angularity being determined by the particular spacing and positioning of the pairs of spacing means or bars 144, 146, 148 and 150.

The several strands are received in the groove or guide slot 160 in the relation illustrated in FIG. 3 whereby they are disposed substantially in a plane normal to the axis of the collet 46 and a package 38. Each of the strands of the roving is successively engaged with the surface of the package as indicated in FIG. 3 as the package rotates, the engagement points on the surface of the package for the respective strands being indicated at a', b', C' and d'.

The strand guide block or member 158 is traversed lengthwise of the package and the strands of the roving are deposited or collected on the package in side-by-side or waywound relation as illustrated schematically in FIG. 5. Heretofore in winding a multistrand roving it has been the usual practice to provide abutment means at the ends of the package being wound such as disclosed in the U.S. Pat. No. to Klink et al. 3,371,877 in order to guide the roving at a reversal of the traverse mechanism so as to provide a square end package.

In the herein described method of winding strands of a roving into a package, the maintenance of the strands in a single plane normal to the axis of the package, as shown in FIG. 3, results in a waywound collection of strands of the roving and effects a crossing of the individual strands at the ends of the package as shown in FIG. 5. Through this method of winding, a square end package is formed without any abutment or compacting means at the ends of a package and wherein the strands of the roving will not slough off the ends of the package.

Figure 6:
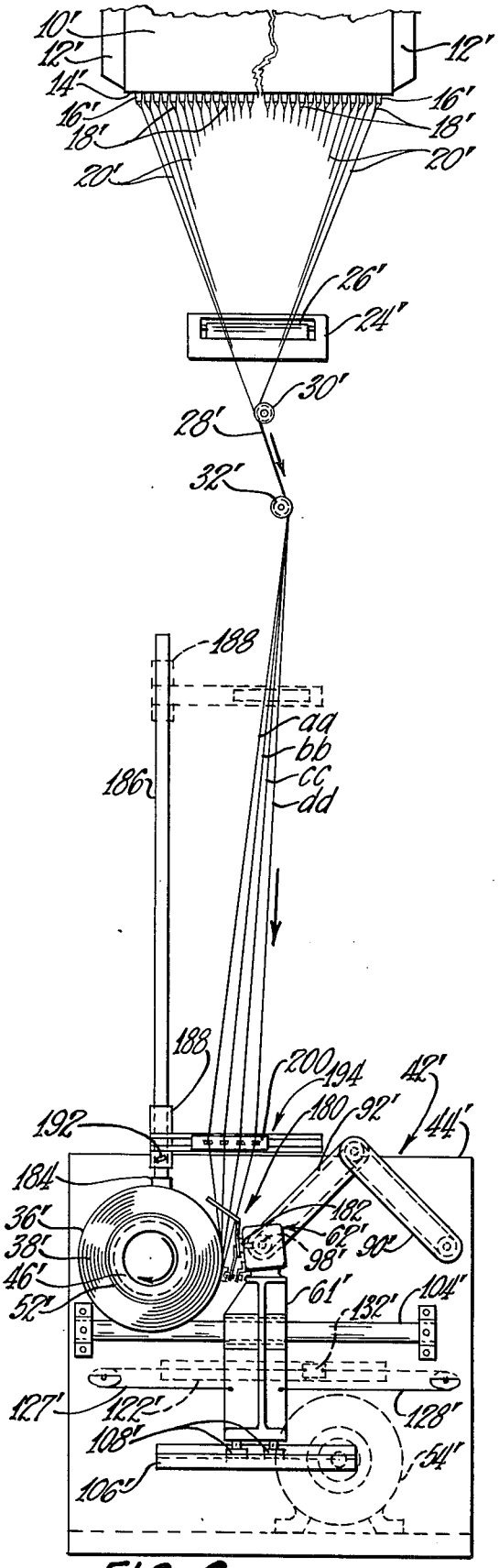
FIG. 6 is a view similar to FIG. 1 embodying an arrangement for use at startup for subdividing a group of filaments into a plurality of strands.
Figure 7:
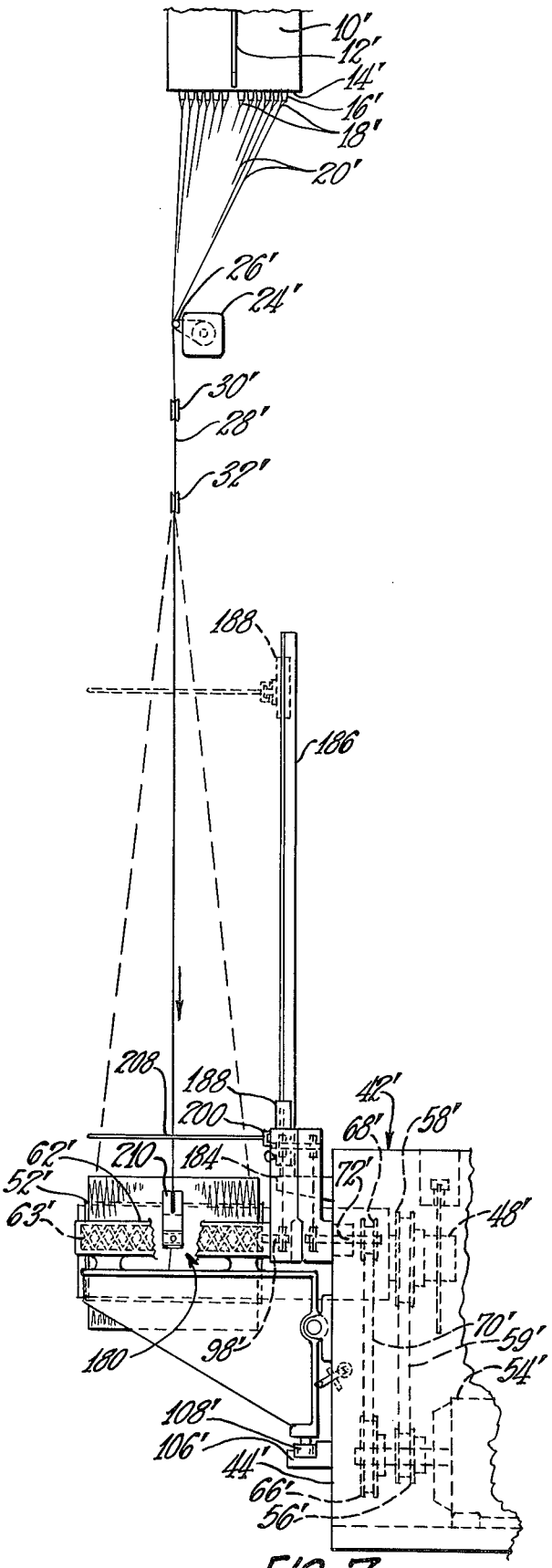
FIG. 7 is a side elevational view of the arrangement shown in FIG. 6.

With particular reference to FIG. 5 it should be noted that the strands a, b, c and d of the roving at the ends of the package are in crossing relation. This condition is attained through the maintenance of the several strands of the roving in a plane normal to the axis of the package and engaging the several strands at successively spaced peripheral regions of the package as illustrated in FIG. 3. FIGS. 6 through 10 illustrate a modified arrangement for carrying out the method of the invention, the arrangement including an adjustable strand spacing means of a character facilitating start-up operations in winding a roving of strands of attenuated filaments into a package. Referring to FIGS. 6 and 7 of the drawings, there is illustrated a stream feeder or bushing 10' containing heatsoftened glass or other filament-forming material.

The feeder 10' may be connected with a forehearth supplied with heat-softened glass from a furnace. The feeder 10' has terminal lugs 12' for connection with a source of electric energy for heating the glass in the feeder. The floor or tip section 14' of the feeder 10' has depending orificed projections 16' for flowing streams 18' of glass which are attenuated into continuous filaments or fibers 20'.

A coating, size or other material may be applied to the filaments from a housing 24' supporting an applicator 26' for transferring the coating or size to the filaments through a wiping actin. The filaments 20' are converged into a linear group 28' by a gathering shoe 30', the group 28' of filaments passing over an idler roll 32'. The group 28' of filaments is subdivided into spaced untwisted strands aa, bb, cc and dd by an arrangement hereinafter described.

The strands form a rowing 36' as the strands are wound into a package 38' on a tube or collector 52' telescoped onto a collect 46', the winding of the strands attenuating the glass streams 18' to filaments 20'. The winding apparatus 42' includes a housing 44' journally supporting a winding mandrel 46' connected with a drive shaft 48' driven by a variable speed motor 54' through an endless belt 59' and sheaves 56' and 58'.

Figure 8:
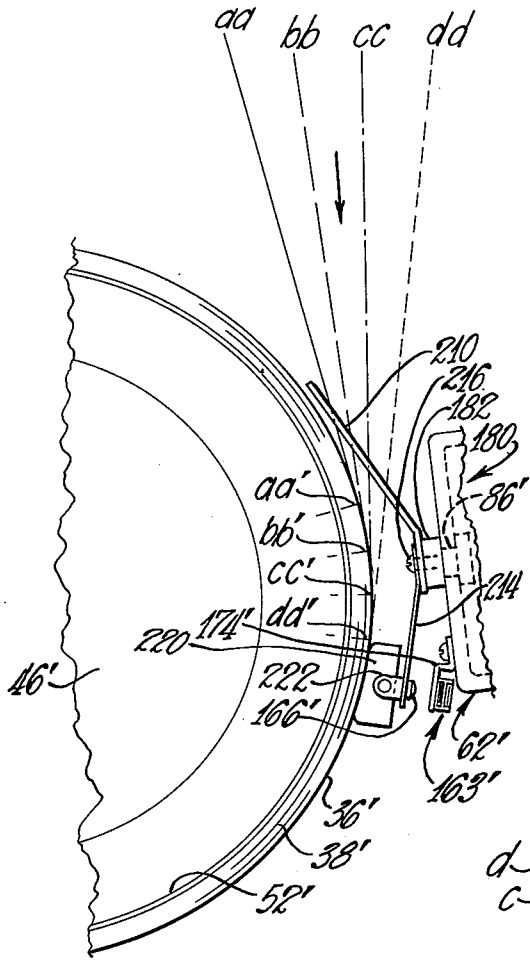
FIG. 8 is a view similar to FIG. 3 illustrating the strand guide means shown in FIG. 6.

As shown in FIG. 8, the arrangement includes a traversing mechanism 180 similar to the traversing mechanism 60 hereinbefore described and which includes a cam housing 62' mounted by a relatively movable support 61'. Journaled in the housing 62' is a cylindrical traversing cam 63' driven by the motor 54'. The traversing means includes a traversing member or slide block 182 similar to the slide block 83 shown in FIG. 3.

The cylindrical traversing cam 63' has a multiple return groove accommodating a cam follower identical with the cam follower 79 illustrated in FIG. 3. The traversing member or slide block 182, mounted in a slot in the housing 62', is reciprocated lengthwise by rotation of the cylindrical traversing cam 63'. The traversing cam 63' is driven by the motor 54', the motor shaft being equipped with a sheave 66' which drives a sheave 68' by a belt 70'.

The sheave 68' is mounted on a shaft 72' and rotates the traversing cam 63' through a drive system of sheaves and endless belts contained within the hollow connectors 90' and 92' in the manner hereinbefore described in reference to FIGS. 1 and 2.

The support 61' is mounted by a shaft or rod 104' and guide rolls 108' slidable in a channel member 106' and is reciprocated by means of an air motor 122' having a cylinder provided with a piston 132' connected by cables 127' and 128' with the support or carriage 61'. The air motor 122' is activated through an arrangement of solenoid-operated valves of the character disclosed in the U.S. Pat. No. to Smith 3,717,311.

FIGS. 6 through 10 illustrate a modified arrangement for separating or splitting the group of filaments 28' into several untwisted strands designated aa, bb, cc and dd wherein the strand spacing means is adjustable with respect to the traverse means to facilitate start-up operations. With particular reference to FIGS. 1 and 2, there is mounted upon a bracket 184 secured to the winding machine housing 44' a vertically disposed stationary rod or member 186 which is preferably of noncircular cross section.

Figure 9:
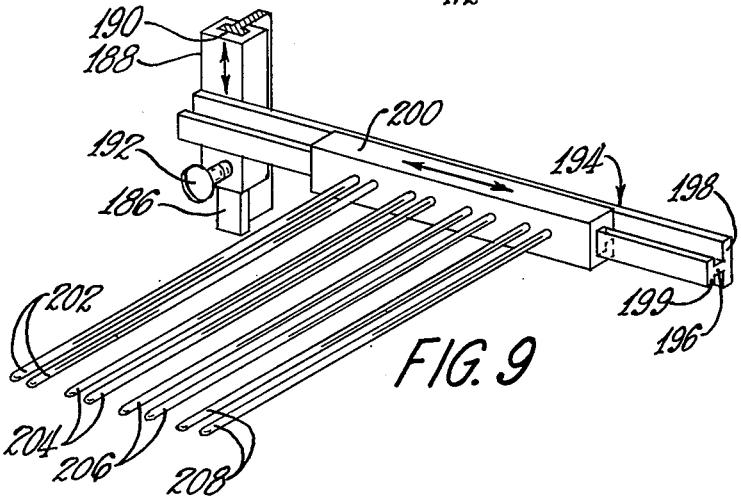
FIG. 9 is an isometric view illustrating the means of FIGS. 6 and 7 for subdividing a group of filaments into multiple strands.

As shown in FIG. 9, the vertically disposed rod is of T-shaped cross section, its upper end terminating below or adjacent the strand guiding idler roll 32'. The slidably mounted upon the rod 186 is a slide element 188 which, as shown in FIG. 9, is fashioned with a T-shaped slot 190 which receives the rod 186. If desired, the element 188 may be provided with a member 192 threaded into an opening in the element 188 and engageable with the rod 186 for securing the element 188 in an adjusted position.

Secured to the slidable element 188 and extending laterially and preferably horizontally of the rod 186 in a plane normal to the axis of the mandrel 46' is a bar 194 of modified T-shape in cross section embodying a central web 196 with flanges 198 and 199 extending from the web. Mounted upon the bar 194 is a carriage or block 200, the carriage 200 having a T-shaped slot therein accommodating the flange 199 of the bar 194. The carriage or block 200 is freely slidable along the bar 194.

The carriage or block 200 is equipped with pairs of strandspacing and guiding bars 202, 204, 206 and 208 as particularly shown in FIGS. 6 and 9. Pairs of bars are spaced apart as shown in FIGS. 6 and 9 and the bars of each pair are spaced sufficiently to receive strands of the filaments. The spacing bars mounted by the carrier or block 200 extend lengthwise of and substantially parallel to the axis of the mandrel 46' and the package being formed thereon and are of a length greater than the length of the package so that the strands remain in the spaces between the pairs of bars throughout a winding operation.

During a winding operation the carriage or block 200 and the strand-spacing pairs of bars are in their lowermost position as illustrated in full lines in FIGS. 6 and 7. With the bar or carrier 200 in its lowermost position, the strands aa, bb, cc and dd are spaced substantially as illustrated in a plane normal to the axis of the package. The member 188, the bar 192, the carriage 200 and the strand spacing bars are slidably adjustable along the vertical rod 186 as a unitary assembly.

During start-up it is desirable, in order to facilitate splitting or separating the group of filaments into strands, to move or elevate the slide element 188 and the components carried thereby to the broken line position shown in FIGS. 6 and 7 in which position the operator can conveniently manually split or separate the group of filaments 28' into the individual strands and thread the respective strands between the pairs of bars 202, 204, 206 and 208.

As winding operations are initiated, the slide element 188 may be moved by the operator to its lowermost position, shown in full lines in FIGS. 6 and 7, and it remains in this position during the winding of a complete package.

Figure 10:
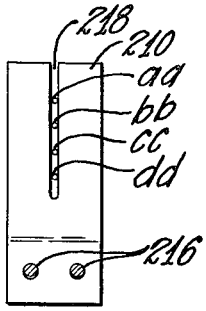
FIG. 10 is an elevational view of guide means for the strands shown in FIG. 8.

The traverse mechanism employed with the strand separaing means of FIGS. 6 and 7 is illustrated in FIGS. 8 and 10. With particular reference to FIG. 8, the traverse housing 62' supports the traverse member 182 for lengthwise reciprocatory movement in a slot 86' under the influence of a cylindrical traversing cam. Secured to the member 182 and extending upwardly therefrom is a strand guide means or member 210. Extending downwardly from the traverse member 182 is a flexible metal strip 214 which forms a plate spring. The member 210 and strip 214 are secured to the traverse member 182 by screws 216.

The member 210 is fashioned with a slot 218 to accommodate the strands aa, bb, cc and dd in spaced relation as shown in FIGS. 8 and 10. It will be noted from FIG. 8 that each of the strands is tangent to the surface of the package but the respective strands engage the surface of the package at spaced peripheral regions which are indicated in FIG. 8 at aa', bb', cc' and dd'.

Thus the several strands in spaced relation are guided by the groove 218 in the member 210 in a plane substantially normal to the axis of the mandrel 46' and the package 38'. As the strands are maintained by the groove or slot 218 in the member 210 in a plane substantially normal to the axis of the package, the several strands of the roving are collected on the package in side-by-side or waywound relation as illustrated in FIG. 5.

A sensor means or block 220 is pivotally supported on projections 222 formed on the flexible metal strip or plate spring 214. A switch means 163' and associated magnet arrangement of the character hereinbefore described is secured by a member 174' to the traverse housing 62'. The sensor means 220 functions in the manner of the sensor means or block 158 for sensing the increasing size of the package. As the package increases in size, the sensor or block 220 is moved radially outwardly by the package, flexing the strip 214.

When the magnet 166' on the strip 214 registers with the magnet adjacent the switch means 163', the strip is attracted toward the switch means 163' momentarily closing the switch thereby activating the solenoid valve system for the air motor 122' to move the support 61' and traverse mechanism 180 a slight distance away from the package. When the magnet 166' is moved out of registration with the switch means 163', the stress of the plate spring 214 reengages the sensor block 220 with the peripheral surface of the package of roving being formed.

With each successive increment in the size of the package effective to close the switch means 163, the cycle of operations above described successively occurs until the package winding operation is completed.

During start-up operations the operator moves the slidable element 188 and its components including the strand spacing bars to approximately the position shown in broken lines in FIGS. 6 and 7. With the strand spacing bars in an elevated position, the operator is enabled to readily subdivide or split the group of filaments 28' into several strands and insert the strands in the spaces between the pairs of bars of projections 202, 204, 206 an 208 to establish separated strands. The operator then lowers the element 188 to the full line position shown in FIGS. 6 and 7. The strands are advanced through the slot 218 in the strand guide 210 mounted by the traverse member 182 so that the strands are arranged in a plane substantially normal to the axis of the package as they are drawn toward the package.

The carriage 200 is readily slidable along the horizontal bar 194 so that as the package 38' increases in size, the carriage 200 is free to move to a position to maintain the several strands in proper relation to the surface of the package and for advancement in the slot 218. The method of the invention as carried out by both forms of the apparatus herein disclosed results in collection of the strands of the roving in waywound or side-by-side relation under the influence of advancing the strands in spaced relation in a plane normal to the axis of the package being formed. By advancing the several strands at different angles toward the surface of the package, the strands are successively engaged with the package at circumferentially spaced peripheral regions in forming the roving.

While the method of the invention has particular utility in forming roving of glass filaments attenuated from glass streams by winding a roving of the filaments into a package, it is to be understood that the method of winding strands of roving a package in accordance with the invention may be utilized in winding a roving of preformed untwisted strands of glass filaments derived from prewound packages or spools of strand.

It is apparent that, within the scope of the invention, modifications and different arrangements may be made other than as herein disclosed, and the present disclosure is illustrative merely, the invention comprehending all variations thereof.

We claim:

1. The method of packaging a roving comprising a plurality of strands of glass fibers including segregating a linear group of the fibers into a plurality of strands, winding the strands of the roving into a package on a rotating mandrel, advancing the strands in separated relation toward the package in a plane substantially normal to the axis of rotation of the package, traversing the strands lengthwise of the package while maintaining the strands adjacent the package in a plane substantially normal to the axis of rotation of the package, and engaging the strands successively with the package surface at peripherally-spaced regions whereby the strands of the roving are collected in side-by-side relation on the package.

2. The method of packaging a roving comprising a plurality of strands of glass fibers including advancing the strands by winding the roving on a rotating mandrel, spacing the advancing strands in a plane substantially normal to the axis of rotation of the package, traversing the strands, lengthwise of the package, and maintaining the strands adjacent the package substantially in a plane normal to the axis of rotation of the package during traversing of the strands whereby the strands are successively engaged with the package at peripherally-spaced surface regions of the package.

3. The method according to claim 2 including the steps of sensing enlargement of the package, and moving the traverse responsive to the sensor away from the package in successive increments as the package increases in size.

4. The method of producing and packaging a roving of untwisted strands of glass filaments including flowing streams of heat-softened glass from a supply, attenuating the streams into continuous filaments, segregating the filaments into a plurality of individual strands, winding the strands into a package on a rotating mandrel, spacing the strands in a plane normal to the axis of the mandrel as they are advanced toward the package whereby the individual strands approach the package at different angles, traversing the strands lengthwise of the package during winding while maintaining the strands adjacent the package in a plane substantially normal to the axis of the mandrel, and engaging the strands successively with the package surface at peripherally-spaced regions whereby the strands of the roving are collected in side-by-side engaging relation on the package.

5. The method of producing and packaging a roving of untwisted strands of glass filaments including flowing streams of heat-softened glass from a supply, attenuating the streams into continuous filaments by winding strands of the filaments as a roving into a package on a rotating mandrel, segregating the filaments into individual strands in advance of winding the strands, spacing the individual strands one from another prior to winding the strands into a package with the strands disposed in a plane normal to the axis of the mandrel whereby the spacing of the strands effects advancement of the strands toward the package at different angles, traversing the strands of the roving lengthwise of the package during winding while maintaining the strands adjacent the package in a plane substantially normal to the axis of the mandrel, and engaging the strands successively with the package surface at spaced points of tangency with the surface whereby the strands of the roving are collected in side-by-side engaging relation on the package.

6. The method of producing and packaging a roving of untwisted strands of glass filaments including flowing streams of heat-softened glass from a supply, attenuating the streams into continuous filaments, segregating the filaments into individual strands, winding the strands into a package on a rotating mandrel, spacing the strands one from another whereby the strands are advanced toward the package in a plane normal to the axis of the mandrel and at different angles with respect to the surface of the package, traversing the strands lengthwise of the package during winding while maintaining the strands adjacent the package in a plane substantially normal to the axis of the mandrel, engaging the strands successively with the package surface at peripherally-spaced regions whereby the strands of the roving are collected in side-by-side relation on the package, sensing enlargement of the package, and moving the traverse responsive to the sensor away from the package as the package increases in size.

7. Apparatus for packaging a roving comprising a pluralit of strands of glass fibers including, in combination, a winding machine having a rotatable mandrel upon which the roving is wound, means spacing the strands one from another as they as advanced toward the package, and means for traversing the strands lengthwise of the package, said traversing means maintaining the spaced strands substantially in a plane normal to the axis of the mandrel whereby the individual strands of the roving successively engage peripherally-spaced surface regions of the package.

8. Apparatus for packaging a roving comprising a plurality of strands of glass fibers including, in combination, a winding machine having a rotatable mandrel upon which the roving is wound, means for traversing the strands of the roving lengthwise of the package, means including members disposed to space the strands one from another whereby the strands of the roving are advanced toward the package in different angular paths, said traversing means maintaining the spaced strands in a plane substantially normal to the axis of the mandrel whereby the individual strands of the roving successively engage peripherally-spaced surface regions of the package as determined by the relative angular paths of the strands.

9. Apparatus according to claim 8 wherein the strand spacing members are movable with the traverse means.

10. Apparatus for packaging a roving comprising a plurality of strands of glass fibers including, in combination, a winding machine having a rotatable mandrel upon which the roving is wound, traverse means, a relatively movable support for the traverse means, means spacing the strands of the roving one from another, said traverse means maintaining the spaced strands in a plane substantially normal to the axis of the mandrel, said spacing means being arranged whereby the individual strands are advanced in different angular paths and successively engage the package at peripherally-spaced surface regions as determined by the angular paths of the strands, and means activated by the enlarging package for moving the support and the traverse means in successive increments away from the package.

11. Apparatus for producing and packaging a roving of strands of glass filaments including, in combination, a stream feeder for flowing streams of heat-softened glass from a supply, a winding machine having a rotatable mandrel upon which a roving of the filaments is wound wherein the winding attenuates the streams of filaments, means separating the filaments into a plurality of strands of filaments and maintaining the strands in spaced relation as they are advanced toward the package, and means for traversing the strands lengthwise of the package, said traversing means maintaining the spaced strands substantially in a plane normal to the axis of the mandrel whereby the individual strands of the roving successively engage peripherally-spaced surface regions of the package.

12. Apparatus for producing and packaging a roving of strands of glass filaments including, in combination, a stream feeder for flowing streams of heat-softened glass from a supply, a winding machine having a rotatable mandrel upon which a roving of the filaments is wound whereby the winding attenuates the streams to filaments, a support, means adjustably mounted by the support including spacing bars for segregating the attenuated filaments into a plurality of strands, said means being movable along the support to a position spaced from the package to facilitate segregation of the filaments into strands, said means being movable to an operating position adjacent the package, and traverse means for traversing the strands lengthwise of the package, said traversing means maintaining the strands in a plane normal to the axis of the package, said strand-spacing members effecting different angular paths of advancement of the strands toward the package whereby the strands successively engage the package at peripherally-spaced surface regions of the package.

13. Apparatus according to claim 12 including a relatively movable element supporting the traverse means said traverse means having a surface engageable with the surface of the package, and means activated by engagement of the surface of the traverse means with the package as the package is enlarged for effecting successive movements of the element and the traverse means away from the package.

14. Apparatus according to claim 12 wherein the means adjustably mounted by the support includes an element slidable on the support, a member extending laterally from the slidable element, and a carriage mounting the strand-spacing bars, said carriage being slidable along the laterally extending member.

* * * * *